United States Patent [19]

Boudreau et al.

[11] Patent Number: 4,878,665

[45] Date of Patent: Nov. 7, 1989

[54] GOLF CUP ADVERTISING DEVICE AND METHOD

[75] Inventors: Louis H. Boudreau; Scott R. Ketterer, both of Phoenix, Ariz.

[73] Assignee: Boudreau/Darque, Inc., St. Louis, Mo.

[21] Appl. No.: 292,364

[22] Filed: Dec. 30, 1988

[51] Int. Cl.[4] ..... A63B 57/00

[52] U.S. Cl. ..... 273/34 R; 273/32 R

[58] Field of Search ..... 273/32 R, 34 R, 34 A, 273/34 B, 176 R, 177 R, 178 R, 181 R, 181 D; 141/331-333; 220/86 R, 307, 305, 306, 293

[56] References Cited

U.S. PATENT DOCUMENTS

| | | | |
|---|---|---|---|
| 951,649 | 3/1910 | Matthews | 273/34 R |
| 1,568,321 | 1/1926 | Coldwell | 273/34 R |
| 3,070,255 | 12/1962 | Krake | 220/86 R |
| 3,436,077 | 4/1969 | Geram | 273/34 R |

FOREIGN PATENT DOCUMENTS

| | | | |
|---|---|---|---|
| 491063 | 3/1953 | Canada | 273/34 R |
| 449776 | 7/1936 | United Kingdom | 273/34 R |

*Primary Examiner*—Richard J. Apley
*Assistant Examiner*—J. Welsh
*Attorney, Agent, or Firm*—Harry M. Weiss

[57] ABSTRACT

A golf cup advertising device and method of assembly is provided. The device includes a golf cup unit having an axis, an insert disc for mounting within the golf cup unit at the bottom thereof and twist-on connection means for attaching the disc to the cup unit. The advertisement is printed on an upper face of the disc for viewing by a golfer or other person, after the flag is removed from the hole. The cup unit includes a cylindrical outer wall, which has an inner ledge, a tubular inner wall, and a plurality of ribs which connect the tubular inner wall to the cylindrical outer wall. The upper surface of the ribs and ledge having an angle of inclination sloping downwardly toward the center thereof. The disc has a lower surface with an angle of inclination which is slightly less than a rib surface angle, so that the disc can bear on the ledge before its assembly to the cup unit. The disc has a radially inner portion having a cylindrical inner surface. The tubular portion has an axial extension which has a cylindrical flange having a cylindrical outer surface. The disc cylindrical inner surface receives and faces the cup cylindrical outer surface and is coaxial therewith. The cylindrical outer surface has a plurality of equally spaced vertical slots which have respective tapered cam grooves with respective lock recesses. The cylindrical inner surface has an equal number of similarly spaced prongs for engaging the vertical slots and for passing through the cam grooves to the lock recesses upon the application simultaneously of a downward force and a twisting moement on the disc.

8 Claims, 2 Drawing Sheets

GOLF CUP ADVERTISING DEVICE AND METHOD

BACKGROUND OF THE INVENTION

1. Field of the Invention

The invention relates to a golf cup advertising device and method of assembly, and, in particular, the invention relates to a golf cup advertising device and method having an advertising insert with twist-on connectors.

2. Related Patent Application

A golf cup advertising device is described in pending U.S. patent application Ser. No. 205,119; filed June 10, 1988 which is assigned to the assignee of this invention. This golf advertising device includes a cup having a plurality of spaced vertical holes and an advertising insert disc having a plurality of similarly spaced push-in snap prongs, which are received in the respective holes. A need still existed to provide a more positive means of attachment of the advertising insert disc to the cup.

SUMMARY OF THE INVENTION

According to the present invention, a golf cup advertising device and method is provided. This device includes a cup with an axis, a coaxial advertising insert disc, and connecting means, wherein the connecting means comprises a projecting inner tubular portion fixedly connected to the cup coaxially therewith, a circular flange having angularly spaced cam grooves, a disc inner portion fixedly connected to the disc and having a coaxial hole for receiving the projecting tubular portion and having a plurality of angularly spaced prongs for receival in the cam grooves by applying an axial force and a twisting moment on the insert disc.

By using the cup tubular portion and the disc hole and by using the cup cam grooves and the disc prongs, the problem of a golfer, or other person, pulling out the advertising insert disc from the golf cup is substantially minimized or avoided.

The foregoing and other objects, features and advantages will be apparent from the following description of the preferred embodiment of the invention as illustrated in the accompanying drawings.

DESCRIPTION OF THE PREFERRED EMBODIMENT

Figure 1:
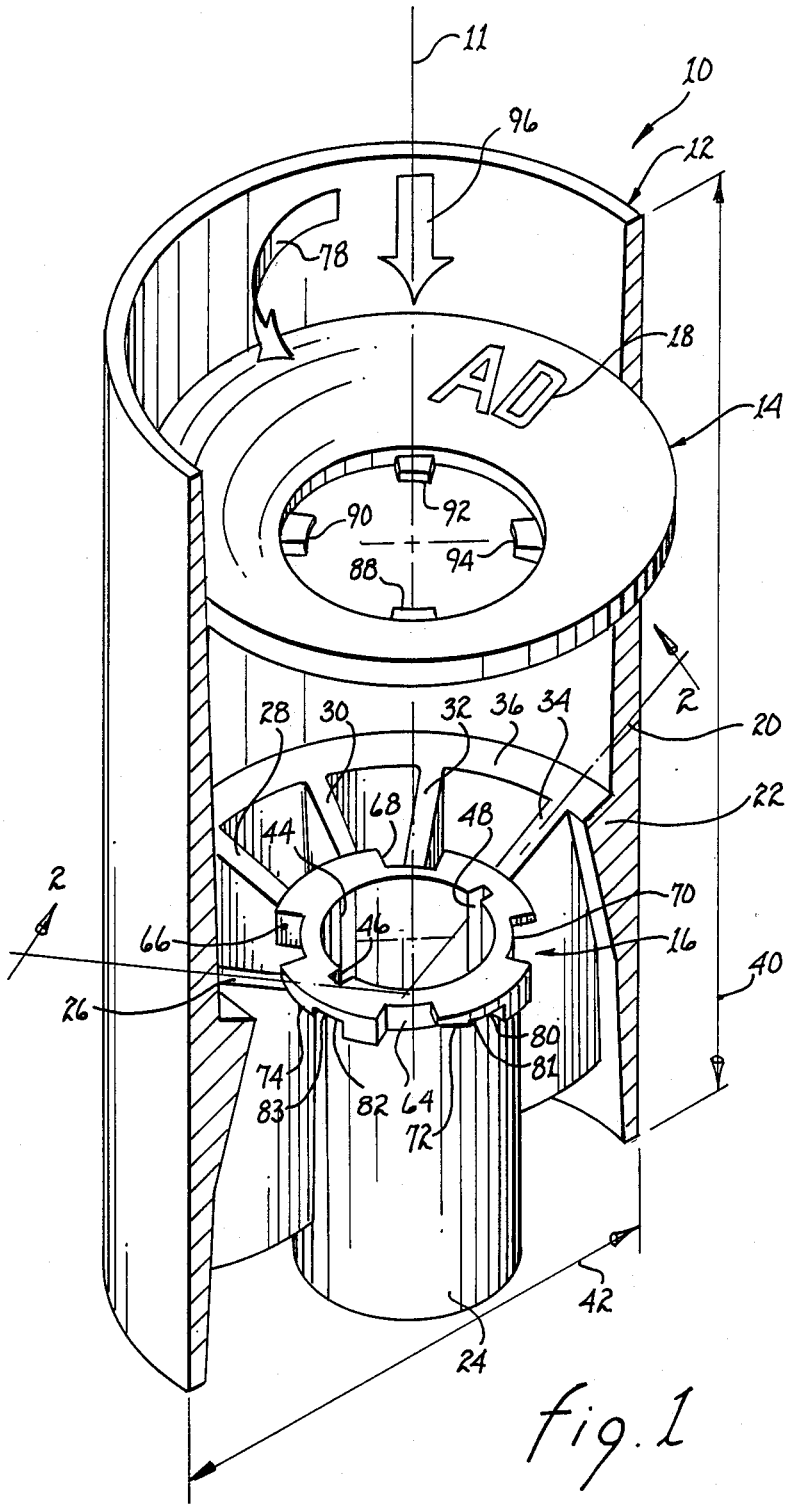
FIG. 1 is a perspective view of a golf cup advertising device according to the invention in position over a golf hole prior to attachment to the golf cup.

As shown in Figure a golf cup advertising device or assembly 10 is provided. Device 10, which has an axis 11, includes a golf cup or golf cup unit or golf cup subassembly 12, an advertising insert or disc or insert member 14, and connecting means or connectors 16. Disc 14 has an advertisement or lettering 18, which is disposed thereon.

Figure 2:
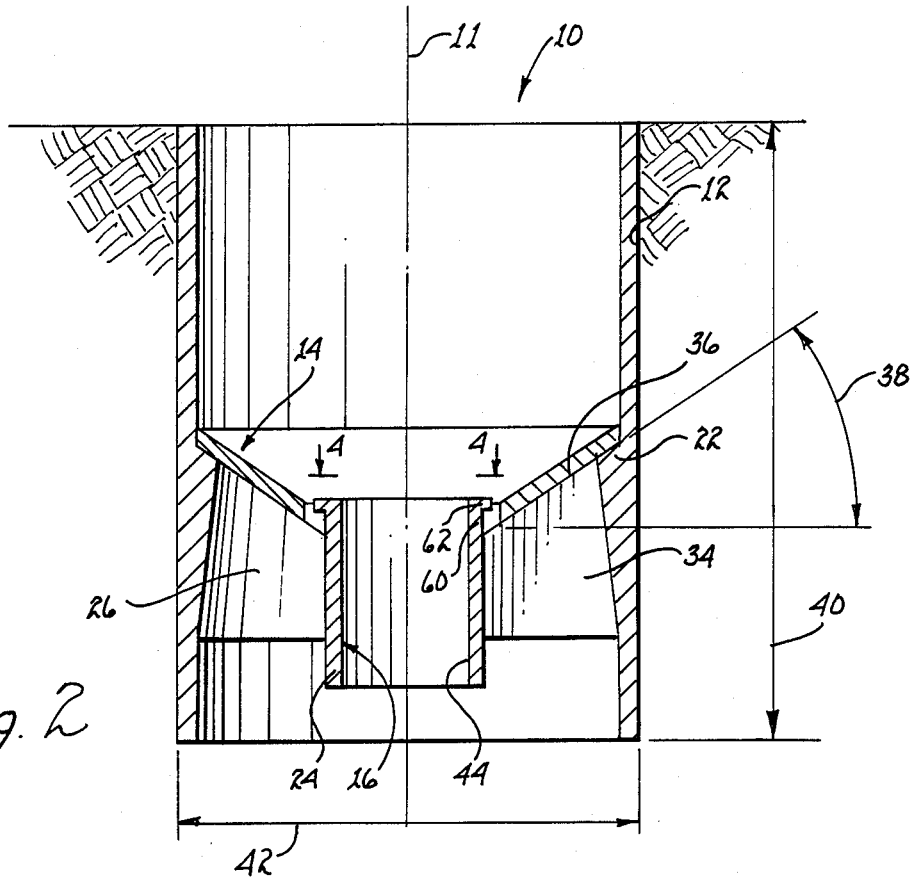
FIG. 2 is a section view as taken along line 2—2 of FIG. 1.

As shown in FIGS. 1 and 2, golf cup unit 12 includes a cylindrical outer wall portion 20, which has an inner ledge portion 22. Cup unit 12 also includes a tubular inner wall portion 24, and a plurality of peripherally spaced ribs or fins or radial walls 26, 28, 30, 32, 34. The fins 26, 28, 30, 32, 34 have a conical upper surface 36, which has an angle 38, that is inclined relative to a horizontal reference line in section view.

As shown in FIGS. 1 and 2, the cylindrical outer wall portion 20 has a length 40 and an outside diameter 42. The dimensions of length 40 and outside diameter 42 are in accordance with the dimensions of a standard golf cup as set by the United States Golf Association (U.S.-G.A.).

As shown in FIGS. 1 and 2, tubular portion 24 has an inner surface 44, which has two fluid drainage grooves 46, 48. Tubular portion 24 normally receives a flag handle or pole (not shown). Water, from rain or drainage, which flows into device 10, flows over disc 14 and then flows down through drainage grooves 46, 48, or flows under disc 14 and then flows down between fins 26, 28, 30, 32, 34, or down along the inside of ledge 22.

Figure 3:
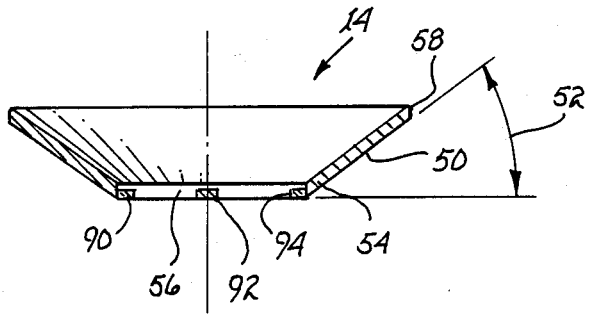
FIG. 3 is a side elevational section view depicting a part of the device of FIG. 2.
Figure 4:
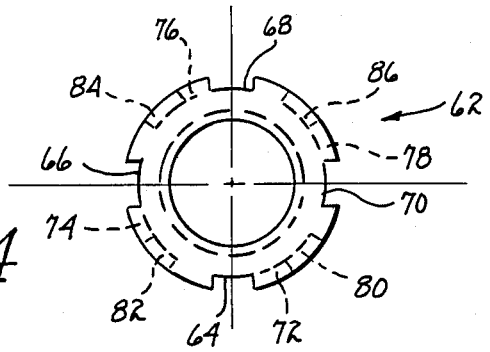
FIG. 4 is a section view as taken along line 4—4 of FIG. 2.

As shown in FIG. 3, disc 14 has a lower surface 50, which has a disc surface angle 52 relative to a reference horizontal line in section view. Angle 52 is normally slightly smaller than angle 38 of fin surfaces 36 (see FIG. 2), so that, before pressing down on disc 14, a portion of disc surface 50 is resting on ledge 22. After pressing down on disc 14, portions of disc surface 50 contact fin surfaces 36.

Disc 14 also has a radially inner portion 54, which has a circular inner surface 56 defining a central aperture in disc 14. Disc 14 also has a circular outer surface 58.

Connecting means 16 includes a bayonet-type, axial, cup extension 60 (see FIG. 2), which is fixedly connected to tubular portion 24, and a circular flange 62, which is fixedly connected to cup extension 60. Flange 62 has a plurality of peripherally spaced slots 64, 66, 68, 70 (see FIG. 1), which have respective tapered or cam grooves or cam portions 72, 74, 76, 78, that have respective lock grooves or lock recesses 80, 82, 84, 86.

Connecting means also includes a plurality of peripherally spaced disc tangs or prongs 88, 90, 92, 94, which are fixedly connected to disc 14 at its inner surface 56 (see Fig. 1). In FIG. 1, four prongs 88, 90, 92, 94, which are spaced at 90 degrees apart, are shown. Prongs 88, 90, 92, 94, are received in respective slots 64, 66, 68, 70 and cam grooves 72, 74, 76, 78 and lock recesses 80, 82, 84, 86.

In the assembly of disc 14 into cup 12, a downward force, as shown by arrow 96 in Figure 1, is applied to disc 14 adjacent to its inner portion 54. Simultaneously, a torque or twisting moment, as shown by arrow 98 in FIG. 1, is applied to disc 14. This causes disc 14 to deflect or deform, so that disc surface 50 confirms to and contacts fin surfaces 36. This also causes prongs 88, 90, 92, 94 to move through respective slots 64, 66, 68, 70 and then through respective cam grooves 72, 74, 76, 78 to respective lock recesses 80, 82, 84, 86. Disc surface 50, when deflected, has an angle equal to fin surface angle 38. Since disc 14 is deflected, disc 14 has a reaction force so that prongs 88, 90, 92, 94 apply a relatively large normal force and friction force on its respective lock recesses 80, 82, 84, 86. Such friction force minimizes the possibility that disc 14 will be rotated to a position where disc 14 can be pulled up from cup 12, by accident, mistake or other like reason.

Lock recesses 80, 82, 84, 86 have respective shoulder portions 81, 83 as shown in FIG. 1. Shoulder portions 81, 83 help to lock respective prongs 88, 90 into place in recesses 80, 82.

A method of assembly of advertisement insert disc 14 into a golf cup 12 is indicated hereafter. First, position disc 14 inside cup 12, so that an outer part of lower surface 50 of disc 14 rests on an inner ledge portion 22 of cup 12. Second, provide an inner tubular portion 60 which has a flange portion 62 that has at least one slot 64 with a connecting cam groove 72 and a connecting lock recess 80, and which is supported by cup 12. Third, provide a disc inner portion 54, which has a circular inner surface 56, that has at least one prong 88, and which is supported by disc 14. Fourth, apply a downward force 96 on disc portion 54 and simultaneously apply a twisting moment 98 on disc 14, so that disc inner portion 54 deflects downwardly and so that prong 88 is urged into slot 64 and so that prong 88 is urged through cam groove 72 and is urged into lock recess 80.

The advantages of device 10 are indicated hereafter:

A. The problem of a golfer, or other person, sometimes accidentally or mistakenly pulling out the advertisement disc 14 from the golf cup 12 (such as when taking a golf ball or flag out of the hole) is avoided.

B. The means of locking and unlocking the disc 14, such as prongs 88, 90, 92, 94 and lock recesses 80, 82 84, 86, are not readily seen by a person looking into the golf cup 12 whereby easy or accidental removal of the disc is avoided.

While the invention has been described in its preferred embodiment, it is to be understood that the words which have been used are words of description rather than limitation and that changes may be made within the purview of the appended claims without departing from the true scope and spirit of the invention in its broader aspects.

WE CLAIM:

1. A golf cup advertisement device including:

a golf cup unit having an axis;

an insert disc having an advertisement thereon and disposed coaxially inside the cup unit; and connection means for connecting the disc to the cup unit, wherein the connection means comprises:

a tubular member having a cylindrical outer surface with a tapered cam groove and being supported by the cup unit; and said disc having a radially inner portion with a cylindrical inner surface for receiving the tubular member and having at least one radial prong which is received in the tapered cam groove.

2. The device of claim 1, wherein:

said disc has a radially outer portion supported by a portion of the golf cup unit; and said disc is flexible for vertically deflecting the disc radially inner portion relative to the radially outer portion through a vertical displacement of selective value while turning the disc about the axis through an angle of selected value whereby the prong is urged in a helical path through the cam groove.

3. The device of claim 2, wherein:

said cup unit has a cylindrical outer wall portion with an inner ledge portion for supporting the radially outer portion of the disc; and said tubular portion has a bayonet-type axial extension having a circular flange portion with the cylindrical outer surface and with the tapered cam groove;

whereby the circular flange outer surface faces the disc inner portion cylindrical inner surface and whereby the prong is disposed adjacent to the vertical slot.

4. The device of claim 3, wherein:

the flange cylindrical outer surface has a plurality of cam grooves with respective vertical slots peripherally spaced apart at the selected angle spacing; and the disc cylindrical inner surface has a plurality of prongs peripherally spaced apart at the same selected angle spacing.

5. A method of assembly of an advertisement disc into a golf cup unit including the steps of:

positioning the disc inside the cup unit along an axis with an outer part of a lower surface of the disc resting on an inner support portion of the cup unit;

mounting an inner tubular portion having a flange portion with a vertical slot and a connecting cam groove and lock recess on the cup unit;

providing a cylindrical surface on a radially inner portion of the disc, said surface having a radial prong projecting therefrom;

applying a downward force on the inner disc portion and simultaneously applying on the disc a twisting moment about the axis; and whereby the disc inner portion deflects downwardly and whereby the prong is urged through the vertical slot and through the cam groove and into the lock recess.

6. A golf cup advertisement device including:

a golf cup unit having an axis;

an insert disc having an advertisement thereon and disposed coaxially within the cup unit; and connecting means connecting the disc to the cup unit, wherein;

said connecting means comprises:

a first member having a first cylindrical surface;

a second member having a second cylindrical surface facing said first cylindrical surface;

said first cylindrical surface having a cam groove with a slot; and said second cylindrical surface having a prong projecting therefrom for receival in said cam groove for locking the disc to the cup unit.

7. An advertisement disc for mounting in a golf cup unit along a common axis comprising:

a cylindrical radially outer portion for support by the golf cup unit;

a cylindrical radially inner portion which together with the cylindrical radially outer portion has the shape of a frustrum of a cone;

said cylindrical radially inner portion being flexible for deflecting in a direction along the axis relative to the cylindrical radially outer portion for a displacement of a selected value when subject to an axial force of a selected value; and said cylindrical radially inner portion having a cylindrical inner portion having a cylindrical inner surface having connection means for engaging an oppositely facing portion of the cup unit upon the simultaneous application of the axial force and a twisting moment on the disc.

8. A golf cup comprising:

a golf cup unit having an axis; and connection means located on said golf cup unit for permitting an advertising disc to be connected to the cup unit, wherein the connection means comprises:

a tubular member having a cylindrical outer surface with at least one tapered cam groove and being supported by the cup unit.

* * * * *